United States Patent [19]

Martens

[11] 4,388,065

[45] Jun. 14, 1983

[54] COMBUSTION FLASH BULB

[75] Inventor: Karlo P. Martens, Terneuzen, Netherlands

[73] Assignee: U.S. Philips Corporation, New York, N.Y.

[21] Appl. No.: 141,714

[22] Filed: Apr. 18, 1980

[30] Foreign Application Priority Data

May 4, 1979 [NL] Netherlands ..... 7903500

[51] Int. Cl.[3] ..... F21K 5/02

[52] U.S. Cl. ..... 431/362

[58] Field of Search ..... 431/357, 358, 359, 362, 431/365; 362/11, 13, 15

[56] References Cited

U.S. PATENT DOCUMENTS

| | | | |
|---|---|---|---|
| 2,490,769 | 12/1949 | Andrea | 431/362 |
| 3,884,615 | 5/1975 | Sobieski | 431/362 |
| 3,930,784 | 1/1976 | Anderson | 431/358 |
| 4,049,369 | 9/1977 | Shaffer | 431/362 |
| 4,082,494 | 4/1978 | Shaffer | 431/362 |
| 4,229,161 | 10/1980 | Bouchard et al. | 431/362 |

*Primary Examiner*—Samuel Scott
*Assistant Examiner*—Lee E. Barrett
*Attorney, Agent, or Firm*—Robert S. Smith

[57] ABSTRACT

High voltage-ignited combustion flash bulbs according to the invention have a first current conductor which extends into a mass of metal strips. The first current conductor is connected inside the envelope to a second current conductor 4 by means of an ignition mass. A porous mass of an electrically insulating material is provided between the second current conductor and the mass of metal strips. The material 8 at least reduces the possibility of failing ignition caused by the ignition current flowing from the first current conductor, via the mass of metal strips, through the ignition mass, to the second current conductor, instead of from the first current conductor, via a longer path through the ignition mass to the second current conductor.

The flash bulb may be incorporated in a flash unit having several such flash bulbs.

9 Claims, 4 Drawing Figures

COMBUSTION FLASH BULB

Figure 1:
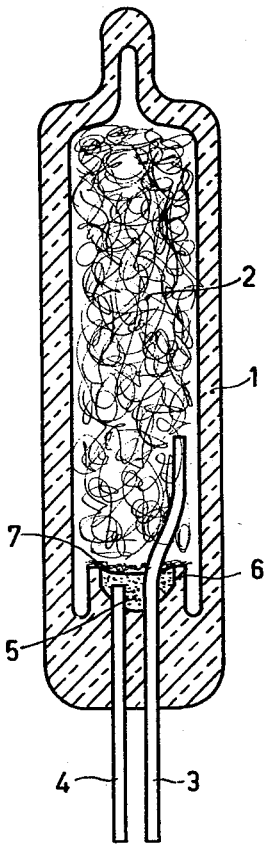

The invention relates to a combustion flash bulb for high voltage ignition having a light-pervious envelope in which a mass of actinically combustible metal strips and an oxidizing gas are present and in which current conductors are led through the wall of the envelope in a vacuum-tight manner and are interconnected inside the envelope by an ignition mass, a first of said current conductors extending through the ignition mass into the mass of metal strips. The invention also relates to a flash unit having several of such combustion flash bulbs.

Such a combustion flash bulb is disclosed for example in German Auslegeschrift No. 2,504,188.

High voltage ignition combustion flash bulbs have the disadvantage that they can ignite spontaneously if an electrostatic charge is formed in the lamp, for example as a result of friction, and flows to the current conductor through the ignition mass. This disadvantage is avoided by constructing one current conductor in such a manner that it is in continuous contact with the mass of metal strips in the lamp envelope. When an electrostatic charge is formed in the lamp, it can immediately flow away through the relevant current conductor. A charge of sufficient energy content to cause breakdown through the ignition mass, and consequently ignition thereof, cannot occur in said construction.

It has been found, however, that combustion flash bulbs with such a first current conductor which is in contact with the mass of metal strips provide insufficient certainty that they will ignite when a high voltage is applied across the current conductors.

It is an object of the invention to provide combustion flash bulbs in which this disadvantage is at least mitigated.

In combustion flash bulbs of the type defined in the opening paragraph this object is achieved in that a porous mass of an electrically-insulating material is provided between the second current conductor and the mass of metal strips.

The flash bulbs according to the invention are based on the recognition that, when a first current conductor is in contact with the mass of metal strips, current will start flowing from the first current conductor to the mass of metal strips and from there via the ignition mass to the second current conductor when the ignition voltage is applied across the current conductors. When the path through the ignition mass is too short, however, breakdown in the ignition mass will not result in ignition of the ignition mass. Breakdown of the mass of metal strips to the second current conductor is counteracted in lamps according to the invention.

The porous mass of insulating material may consist of woven or non-woven fibres or of a perforated plate.

In an embodiment which is very simple to realize a granular material is used, for example balls of the material.

The mass may consist of glass, quartzglass, silicates, or insulating metal oxides, for example $Al_2O_3$ and $ZrO_2$.

By using the mass of insulating material, the distance from the mass of metal strips to the second current conductor is enlarged. If said distance is larger than the smallest distance between the current conductors within the ignition mass, when a high voltage is applied across the current conductors, breakdown will take place in the ignition mass and will result in ignition of the lamp. Since in high voltage-ignited combustion flash bulbs the smallest distance between the current conductors in a lamp is approximately 1 mm, only very little mass of insulating material is necessary to effect that the mass of metal strips remains at a sufficient distance from the second current conductor.

If the insulating mass has some coherence, as in the case in which fibers are used, the mass may be present loosely in the lamp envelope. If a granular material is used, this may be provided in the lamp envelope before the ignition mass has lost all the diluent which it contained when it was provided in the envelope. The grains will remain adhering to the ignition mass. It is alternatively possible to introduce the insulating mass into the envelope shortly after providing the paste from which, after drying, the ignition mass is formed. The insulating mass, in fibrous or granular form may then be incorporated entirely or partly in the surface layer of the ignition mass. It has furthermore proved possible to introduce granular material together with the ignition paste into the lamp envelope.

It has been found that the insulating mass has no detrimental influence on the operation of the flash bulb. On the contrary, in flash bulbs in which the ignition mass has to produce a conductive path between the current conductors after flashing the bulb, it was found that with great certainty after flashing a low resistance was formed between the current conductors than without the use of the insulator mass.

It has proved very easy to manufacture flash bulbs in accordance with the invention by using granular material, in particular glass beads, having a diameter generally between 100 and 1000 $\mu$m.

It is to be noted that a combustion flash bulb with filament ignition is known from U.S. Pat. No. 3,930,784 in which glass balls are present on the bottom of the envelope. However, it is not the object of these balls to hold the lamp in a given condition for flashing, as in the case in flash bulbs according to the invention, but to reach a certain condition in the lamp after flashing; namely to prevent metal particles from depositing on the bottom of the envelope and forming a conductive path between the current conductors when the flash bulb is flashed.

The invention also relates to a flash unit comprising a plurality of combustion flash bulbs in accordance with the invention.

The flash bulbs and the unit according to the invention may be used to illuminate a scene for photographic purposes.

Figure 2:
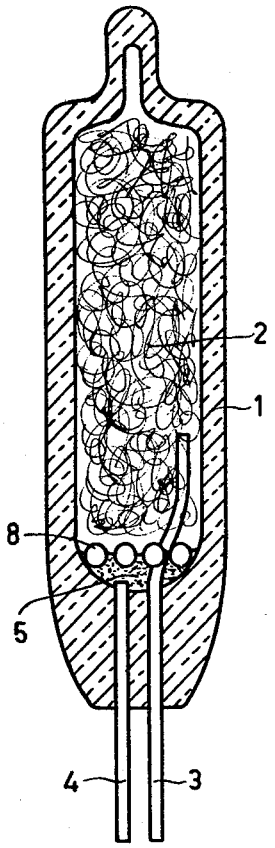
Figure 4:
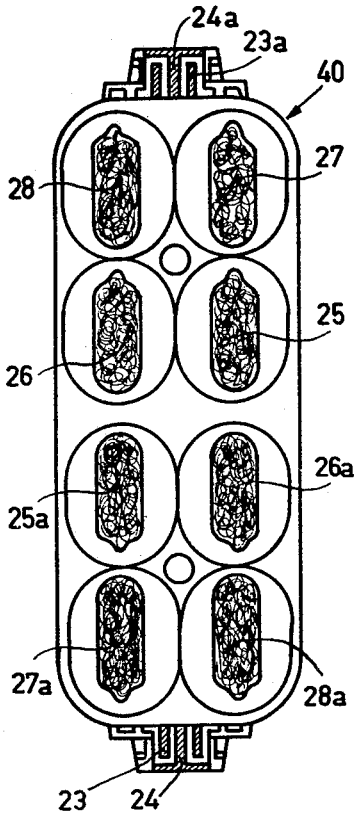
Figure 3:
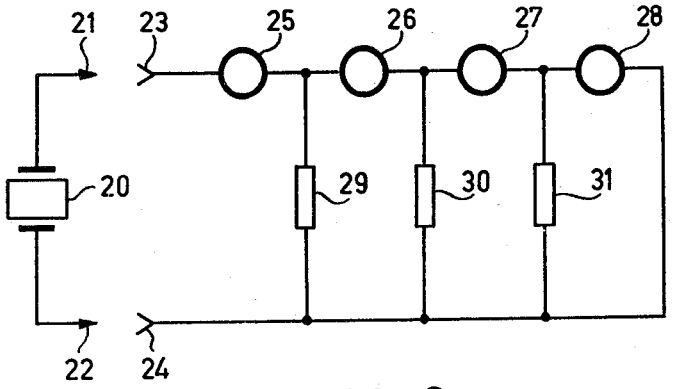

Embodiments of flash bulbs and of a flash unit according to the invention are shown in the accompanying drawing, of which FIG. 1 is a longitudinal sectional view of a combustion flash bulb, FIG. 2 is a longitudinal sectional view of a second embodiment of a flash bulb, FIG. 3 shows an electric circuit diagram of a flash unit, and FIG. 4 is an elevation of a flash unit.

In FIG. 1 a glass envelope 1 endoses a mass of metal strips 2 and oxygen as an oxidizing gas. Current conductors 3 and 4 are sealed in the wall of the envelope 1 in a vacuum-tight manner and open into a cup portion 6 in which an ignition mass 5 is present, which connects the current conductors. A first current conductor 3 extends through the ignition mass 5 into the mass of metal strips 2. A porous mass of an electrically insulating material in the form of glass fibres 7 is present between the second current conductor 4 and the mass of metal strips 2.

The ignition mass 5 in FIG. 2 which connects the current conductors 3 and 4 is provided in the bottom (as viewed in FIG. 2) of the envelope 1. A porous mass of an electrically insulating material in the form of glass beads 8 is present between the second current conductor 4 and the mass of metal strips 2. FIG. 3 shows a plurality of flash bulbs 25 to 28 and heat-sensitive break switches 29, 30 and 31. The circuit shown can be connected to the output contacts 21 and 22 of a high voltage source 20 by means of input contacts 23 and 24.

The operation of the circuit is as follows. When contacts 21 and 22 of the voltage source 20 are connected to the respective input contacts 23 and 24 and the voltage source gives a voltage pulse for the first time, the circuit 23, 25, 29, 24 will be traversed, since the flash bulbs 26, 27 and 28 are still short-circuited by the break switch 29. The flash bulb 25 is ignited by the voltage pulse and irradiates break switch 29 causing it to open. The flash bulb 26 is now ready for ignition. When a second voltage pulse is generated, the circuit 23, 25, 26, 30, 24 is traversed, flash bulb 26 ignites and switch 30 is opened and so on to flash bulb 28.

The flash unit 40 shown in FIG. 4 has two series of four flash bulbs, namely 25, 26, 27, 28 and 25*a*, 26*a*, 27*a*, 28*a*, and two pairs of input contacts, namely 23, 24 and 23*a*, 24*a*. When the input contacts 23 and 24 of the device are connected to the output contacts of a high voltage source, the flash bulbs 25 to 28 can be ignited in sequence. When the input contacts 23*a* and 24*a* are connected to a high voltage source, the flash bulbs 25*a* to 28*a* can be ignited in sequence.

EXAMPLE

A high voltage ignition combustion flash bulb having a hard glass envelope of inside diameter 5.1 mm and an internal volume of 0.28 $cm^3$ was provided with 14.5 mg of zirconium strips (dimensions $0.02\times0.025\times7$ mm) and oxygen at a pressure of 15 bars.

Two current conductors (18% by weight of Co, 28% by weight of Ni, 54% by weight of Fe and diameter 0.4 mm) were sealed in the wall of the envelope in a vacuum-tight manner and connected inside the envelope by an ignition mass which was provided in the bottom thereof and consisted of 88% by weight of Zr and 12% by weight of $KC10_4$ in 1% by weight of hydroxyethyl cellulose calculated on the combined weight of the above components.

Glass beads having a diameter of 820 μm were present at the surface of the ignition mass.

One of the current conductors extended in the envelope over a distance of ⅓ of the length of the latter and was surrounded by the mass of zirconium strips.

When manufacturing the flash bulb, after sealing the current conductors in the wall of the envelope, the ignition mass was provided in the form of a dispersion in water. With the ignition mass still wet, the glass beads were provided in the bulb and were incorporated at least partly in the ignition mass. After drying the ignition mass, the zirconium strips were provided in the envelope after which the open end of the envelope was drawn into a capillary. The envelope was then filled with oxygen via the capillary and the latter was sealed.

Flash bulbs thus constructed proved to be reliable both as regards their resistance to the effects of electrostatic charges and as regards their reliable ignition upon applying a voltage pulse of 2 kV. After flashing, the flash bulbs had a resistance of less than $10^4$ Ohm as against more than $10^{10}$ Ohm prior to flashing.

What is claimed is:

1. A combustion flash bulb for high-voltage ignition having a light-pervious envelope in which a mass of actinically combustible metal strips and an oxidizing gas are present and in which current conductors are led through the wall of the envelope in a vacuum-tight manner and are interconnected inside the envelope by an ignition mass, a first of said current conductors extending through the ignition mass into the mass of metal strips, characterized in that a porous mass of an electrically insulating material is provided between the second current conductor and the mass of metal strips.

2. A combustion flash bulb as claimed in claim 1, characterized in that the said porous mass insulator consists of a granular material.

3. A combustion flash bulb as claimed in claim 1, characterized in that particles of the granular material are incorporated in the ignition mass.

4. A flash unit having a plurality of high voltage-ignited combustion flash bulbs, each having a light-pervious envelope in which a mass of actinically combustible metal strips and an oxidizing gas are present and in which current conductors are led through the wall of the envelope in a vacuum-tight manner and are interconnected inside the envelope by an ignition mass, a first of said current conductors extending through the ignition mass into the mass of metal strips, characterized in that a porous mass of an electrically insulating material is provided between the second current conductor and the mass of metal strips.

5. Apparatus as described in claim 4, characterized in that the said porous mass insulator consists of a granular material.

6. Apparatus as described in claim 5, characterized in that particles of the granular material are incorporated in the ignition mass.

7. A high voltage ignited combustion flash bulb, having a light-pervious envelope in which a mass of actinically combustible metal strips and an oxidizing gas are present and in which current conductors are led through the wall of the envelope in a vacuum-tight manner and are interconnected inside the envelope by an ignition mass, a first of said current conductors extending through the ignition mass into the mass of metal strips, characterized in that a porous mass of an electrically insulating material is provided between the second current conductor and the mass of metal strips.

8. Apparatus as described in claim 7, characterized in that the said porous mass insulator consists of a granular material.

9. Apparatus as described in claim 8, characterized in that particles of the granular material are incorporated in the ignition mass.

* * * * *